US007724188B2

(12) United States Patent
Liu

(10) Patent No.: US 7,724,188 B2
(45) Date of Patent: May 25, 2010

(54) GIMBAL SYSTEM ANGLE COMPENSATION

(75) Inventor: Yong Liu, San Marino, CA (US)

(73) Assignee: The Boeing Company, Chicago, IL (US)

( * ) Notice: Subject to any disclaimer, the term of this patent is extended or adjusted under 35 U.S.C. 154(b) by 173 days.

(21) Appl. No.: 12/126,134

(22) Filed: May 23, 2008

(65) Prior Publication Data

US 2009/0289850 A1 Nov. 26, 2009

(51) Int. Cl.
*H01Q 3/00* (2006.01)

(52) U.S. Cl. ..... 342/359

(58) Field of Classification Search ..... 342/359
See application file for complete search history.

(56) References Cited

U.S. PATENT DOCUMENTS

| | | | | |
|---|---|---|---|---|
| 4,823,134 | A | 4/1989 | James et al. | |
| 5,172,122 | A | 12/1992 | Peregrim et al. | |
| 6,396,233 | B1 | 5/2002 | Christison et al. | |
| 6,538,602 | B2 * | 3/2003 | Natsume et al. | 342/359 |
| 6,842,153 | B2 | 1/2005 | Challoner | |
| 7,123,876 | B2 * | 10/2006 | Wang et al. | 455/25 |
| 7,124,001 | B2 | 10/2006 | Li et al. | |
| 7,239,976 | B2 | 7/2007 | Coleman et al. | |
| 2003/0169201 | A1 | 9/2003 | Dybdal et al. | |
| 2007/0027590 | A1 | 2/2007 | Liu et al. | |
| 2007/0046537 | A1 | 3/2007 | Tekawy et al. | |

FOREIGN PATENT DOCUMENTS

| | | | |
|---|---|---|---|
| GB | 2438505 | A | 11/2007 |
| WO | WO 2005/025109 | A2 | 3/2005 |
| WO | WO 2006/065892 | A2 | 6/2006 |

OTHER PUBLICATIONS

Combined Search and Examination Report under Sections 17 and 18(3), Great Britain Application No. GB0908518.4, Jul. 6, 2009, (5 pgs).

* cited by examiner

*Primary Examiner*—Thomas H Tarcza
*Assistant Examiner*—Harry Liu
(74) *Attorney, Agent, or Firm*—Toler Law Group

(57) ABSTRACT

Gimbal system angle compensation methods and systems are provided. A particular method includes pointing an antenna at a first target using an initial set of at least four gimbal angles and determining first bore sight pointing errors resulting from a pointing direction of the antenna relative to the first target. The method also includes estimating values of a plurality of independently observable error variables based on the first bore sight pointing errors. The method further includes determining a set of gimbal angle corrections based on the values of the plurality of independently observable error variables.

20 Claims, 10 Drawing Sheets

GIMBAL SYSTEM ANGLE COMPENSATION

FIELD

The present disclosure is generally related to gimbal system calibration and pointing angle compensation.

BACKGROUND

Where an antenna or a similar payload is installed on a gimbal system, such that the antenna is used to point at a selected target, overall pointing direction performance may be adversely affected by intrinsic errors that exist in various system locations, such as inboard, internal, and outboard locations of the gimbal system. Pointing performance after an antenna mapping calibration may still be sensitive to the gimbal angles of the gimbal system, especially in the case where the antenna needs to cover a large field of view. Many of the intrinsic errors are due to components of the gimbal system that are not readily measurable which can cause difficulty in calibration, control, and pointing accuracy. Pointing control and accuracy are particularly challenging for applications where the antenna is mounted on a moving platform (e.g., a satellite or a ship) and is pointing at a fixed or moving target. These errors may be even more difficult to correct where the gimbal system includes multiple gimbals (e.g., two or more two-axis gimbals).

SUMMARY

In a particular illustrative embodiment, a system includes a host vehicle interface adapted to be coupled to a host vehicle and to a gimbal system. The gimbal system includes a first gimbal coupled to the host vehicle interface, a platform coupled to the first gimbal, a second gimbal coupled to the platform, and a first directional payload interface coupled to the second gimbal.

In another particular illustrative embodiment, a method includes setting at least four nominal gimbal angles to point an antenna at a target based at least partially on location information associated with the target. The method also includes identifying a set of corrected gimbal angles based on the set of at least four nominal gimbal angles and based on a set of gimbal angle corrections. The method also includes pointing the antenna using the set of corrected gimbal angles. The set of gimbal angle corrections is determined based at least partially on one or more bore sight measurements of the antenna.

In another particular illustrative embodiment, a method includes pointing an antenna at a first target using an initial set of at least four gimbal angles and determining first bore sight pointing errors resulting from a pointing direction of the antenna relative to the first target. The method also includes estimating values of a plurality of independently observable error variables based on the first bore sight pointing errors. The method further includes determining a set of gimbal angle corrections based on the values of the plurality of independently observable error variables.

DETAILED DESCRIPTION

Figure 1:
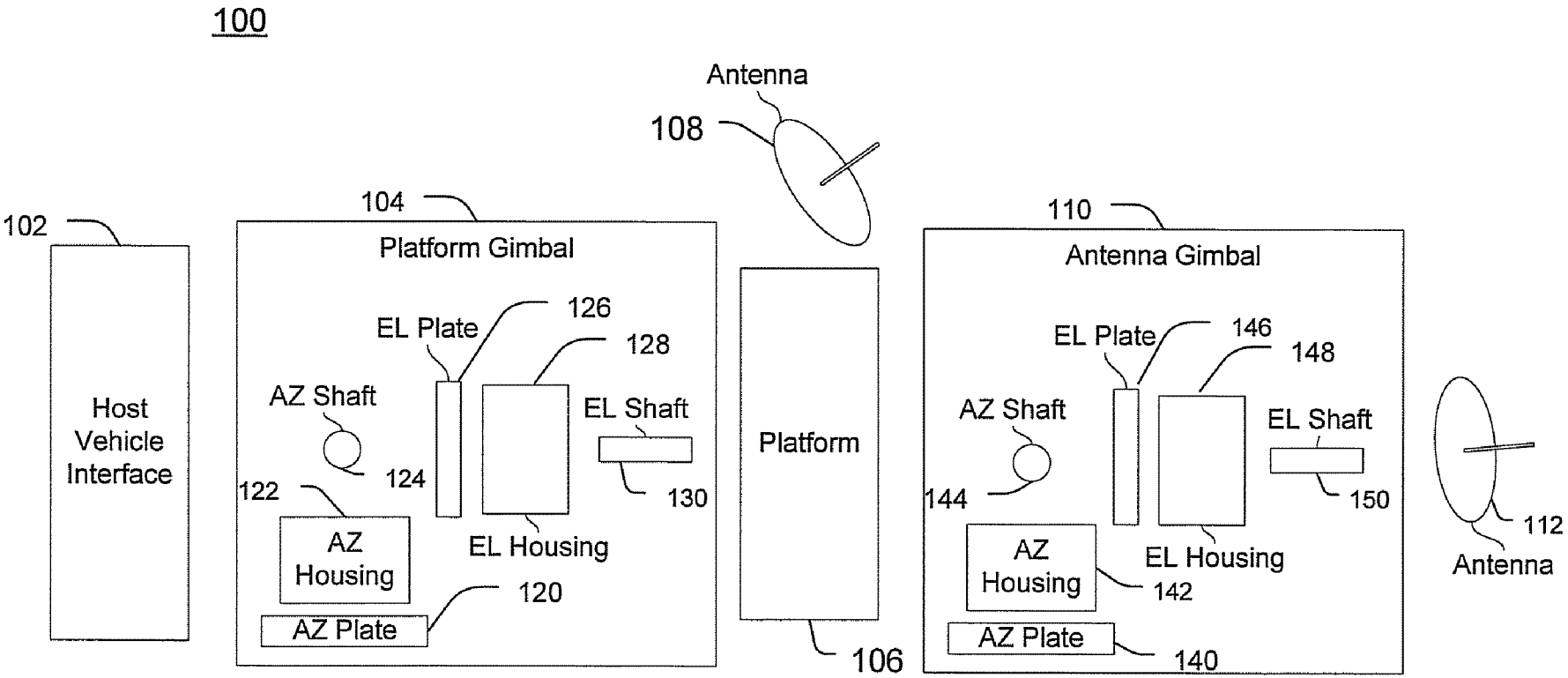
FIG. 1 is a block diagram of a first particular embodiment of a gimbal system.

Referring to FIG. 1, a particular illustrative embodiment of a system 100 is illustrated. The system 100 includes a host vehicle interface 102, a two-axis platform gimbal 104, a platform 106, and a two-axis antenna gimbal 110. The platform 106 is supported by the platform gimbal 104, and the platform 106 is coupled to a first antenna 108. The antenna gimbal 110 is supported by the platform 106, and the antenna gimbal 110 is coupled to a second antenna 112. The first and second antennas 108, 112 may alternatively be substituted by other pointing devices, such as a laser or other directional payload.

The platform gimbal 104 includes a plate assembly 120, a housing 122, a shaft 124, a second plate 126, a second housing 128, and a second shaft 130. In a particular embodiment, the platform gimbal 104 has at least two axes, an azimuth axis and an elevation axis. In this embodiment, the first plate 120, the housing 122 and the shaft 124 are related to an azimuth of the platform gimbal 104, and the second plate 126, the second housing 128, and the second shaft 130 are related to an elevation of the platform gimbal 104. Thus, both the azimuth and the elevation of the platform 106 relative to the host vehicle interface 102 can be adjusted using the platform gimbal 104.

The antenna gimbal 110, which is supported by the platform 106, includes a first plate 140, a first housing 142, and a first shaft 144. The antenna gimbal 110 also includes a second plate 146, a second housing 148, and a second shaft 150. In a particular embodiment, the antenna gimbal 110 has at least two axes, an azimuth axis and an elevation axis. In this embodiment, the first plate 140, the housing 142 and the shaft 144 are related to an azimuth of the antenna gimbal 110, and the second plate 146, the second housing 148, and the second shaft 150 are related to an elevation of the antenna gimbal 110. Thus, both the azimuth and the elevation of the second antenna 112 relative to the platform 106 can be adjusted using the antenna gimbal 110.

The system 100 enables independent pointing of the first antenna 108 and the second antenna 112, even while a host vehicle coupled to the host vehicle interface 102 is in motion. For example, the first antenna 108 can be pointed at a first target using the platform gimbal 104 and the second antenna 112 can be pointed at a second target using the antenna gimbal 110.

Calibration of the system 100 by measuring errors related to each mechanical component may be difficult. However, in a particular embodiment, the system 100 can be calibrated based on bore sight measurements or other pointing error measurements taken with respect to the second antenna 112. The pointing direction of the second antenna 112 is affected by 11 independently observable error variables, including: rotation of the host vehicle about x-, y-, and z-axes; non-orthogonality of the first shaft 124 and the second shaft 130 of the platform gimbal 104; rotation of the platform 106 about x-, y-, and z-axes; non-orthogonality of the first shaft 144 and the second shaft 150 of the antenna gimbal 110; and rotation of the second antenna 112 about x-, y- and z-axes. For some applications, rotation of the second antenna 112 about the z-axis is not applicable; thus, only 10 independently observable error variables may contribute to the pointing errors. In a particular embodiment, values of the independently observable variables can be estimated by measuring pointing error of the second antenna 112 related to various gimbal angles of the platform gimbal 104 and the antenna gimbal 110. For example, pointing error measurements can be made by pointing the second antenna 112 at a target while the host vehicle is at different attitudes. In another example, pointing error measurements can be made by pointing the second antenna 112 at different targets. In still another example, pointing error measurements can be made by pointing the second antenna 112 at the same target using a different set of platform and antenna gimbal angles. The estimates of the independently observable variable values can be used to calibrate the system 100 by determining gimbal angle adjustments to be made during pointing of the first antenna 104, the second antenna 112, or both.

Figure 2:
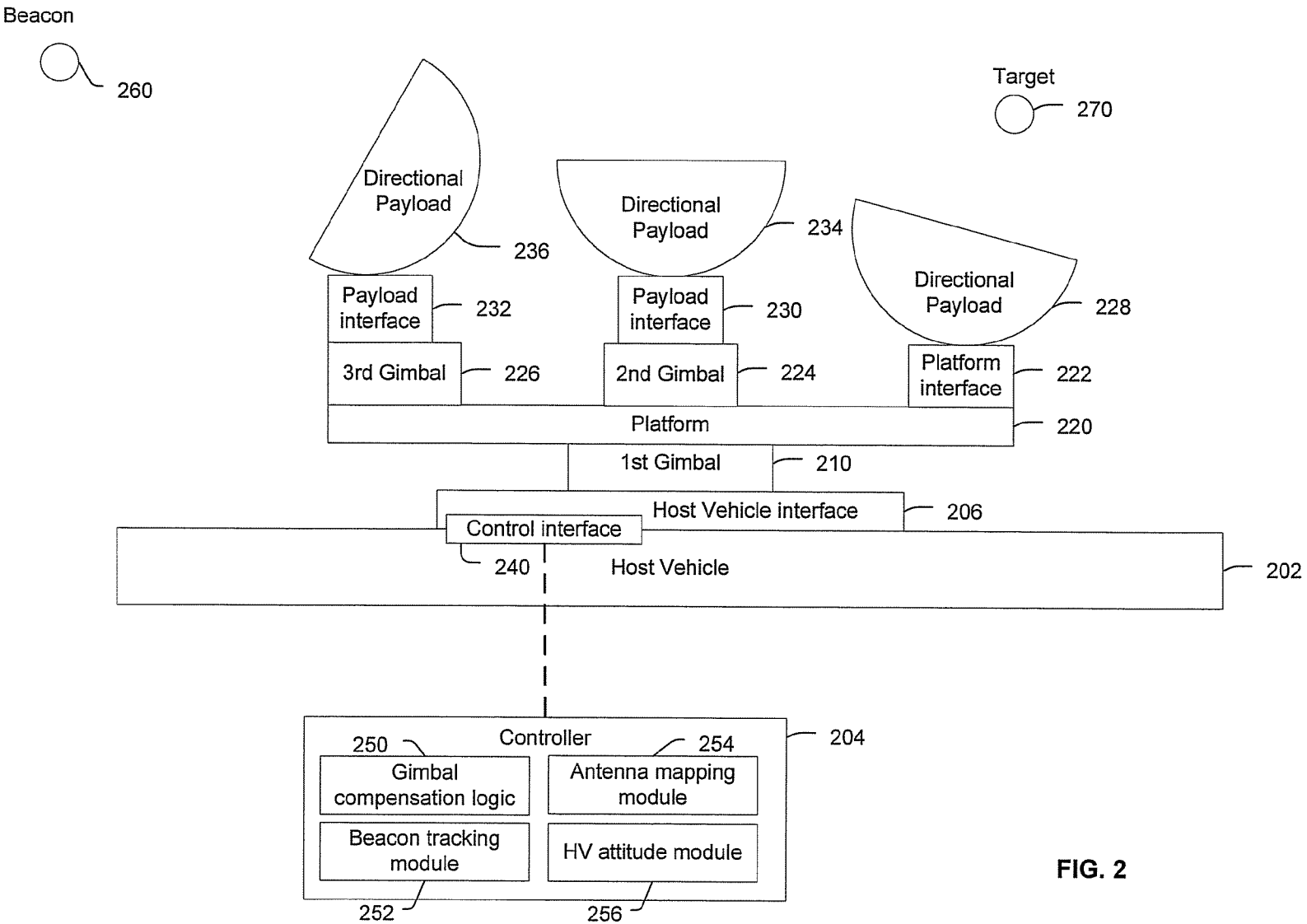
FIG. 2 is a block diagram of a second particular embodiment of a gimbal system.

Referring to FIG. 2, a second particular illustrative embodiment of a system is illustrated. The system includes a host vehicle 202, such as a satellite, a ship, an aerial vehicle or another movable vehicle. The host vehicle 202 is coupled by a host vehicle interface 206 to a first gimbal 210. The first gimbal 210 supports a platform 220 via which equipment or tools can be coupled to the host vehicle 202. For example, one or more platform interfaces, such as representative platform interface 222, can be coupled to the platform 220. The platform interface 222 supports a first directional payload 228. In another example, one or more additional gimbals, such as a second gimbal 224, a third gimbal 226, or both, may be coupled to the platform 220. The second gimbal 224 may be coupled to a second payload interface 230, and the third gimbal, when present, may be coupled to a third payload interface 232. The second payload interface 230 may support a second directional payload 234, and the third payload interface 232 may support a third directional payload 236. While three directional payloads are illustrated in FIG. 2, the system can include any number of directional payloads, including fewer than or more than three payloads. Likewise, while two additional gimbals are shown coupled to the platform, the platform can include any number of additional gimbals, including fewer than or more than two additional gimbals. In a particular embodiment, the system includes the first gimbal 210 and at least one additional gimbal, such as the second gimbal 224.

The directional payloads 228, 234, 236 may include a tool or device adapted to be pointed toward a desired location. Illustrative, non-limiting examples of directional payloads 228, 234, 236 include antennas, lasers and optical devices (e.g., telescopes or cameras). The system may be used to control and direct one or more of the directional payloads 228, 234, 236 toward a beacon 260 or a target 270. The beacon 260 may be used to provide alignment information with respect to one or more of the directional payloads 228, 234, 236 or the host vehicle 202 for navigation, direction, or calibration. In a particular embodiment, the beacon 260 provides a signal from a known location and the host vehicle 202 is a moving vehicle, such as a ship, an airplane, or a satellite.

In a particular embodiment, the first gimbal 210 has at least two axes of rotation and the second and third gimbals 224 and 226 each have at least two axes of rotation. Hence, the pointing direction (e.g., azimuth and elevation) of the first directional payload 228 relative to the host vehicle 202 may be adjusted by using the first gimbal 210 to change the orientation of the platform 220. The pointing directions of the second directional payload 234 and the third directional payload 236 may be changed independently of each other and independently of the orientation of the platform 220 by adjusting the second gimbal 224 and the third gimbal 226, respectively. For example, as the host vehicle 202 moves, the pointing direction of the first directional payload 228 may be maintained by adjusting gimbal angles of the first gimbal 210 to compensate for the movement of the host vehicle 202. Additionally, the pointing direction of the second directional payload 234 may be maintained by adjusting the gimbal angles of the second gimbal 224 to compensate for the movement of the host vehicle and, if needed, the movement of the platform 220. Similarly, the pointing direction of the third directional payload 236 may be maintained by adjusting the gimbal angles of the third gimbal 226 to compensate for the movement of the host vehicle 202 and, if needed, the movement of the platform 220.

The system also includes a control interface that includes or communicates with a controller 204. The controller 204 may be located onboard the host vehicle 202 or remote from the host vehicle 202. For example, where the host vehicle 202 is a satellite, all of or a portion of the controller 204 may be located at a ground station (not shown), all of or a portion of the controller 204 may be onboard the satellite, or any combination thereof. The controller 204 includes gimbal compensation logic 250, a beacon tracking module 252, an antenna mapping module 254, and a host vehicle attitude module 256. In a particular embodiment, the controller 204 includes one or more processors and memory. The one or more processors may execute computer instructions stored in the memory to implement and execute the various functions of the controller, such as the functions exemplified by the modules 252, 254, 256 and the logic 250 illustrated in FIG. 2.

In a particular embodiment, the multiple gimbal arrangement illustrated in FIG. 2, enables independent pointing of the directional payloads 228, 234, 236 at separate targets as the host vehicle 202 moves. However, each gimbal may introduce error in the pointing of the directional payloads 228, 234, 236. For example, pointing errors due to non-orthogonality of the azimuth and elevation axis of each gimbal may be present. Additionally, other pointing errors may be related to the gimbal angles of each gimbal 210, 224, 226, the control system, attitude information related to the host vehicle 202 or platform 220, and so forth. In an illustrative embodiment, a pointing direction of each directional payload is controlled by adjusting gimbal angles of the gimbals 210, 224, 226 to account for a set of independently observable values.

In an exemplary embodiment, the independently observable error variables include at least one error variable related to one or more of an attitude of the host vehicle 202, an attitude of the platform, an attitude of the antenna or other type of pointing device, orthogonality of axes of the antenna gimbal, or orthogonality of axes of the platform gimbal. For example, the pointing direction of the second directional payload 234 may be determined based on error values related to host vehicle rotation about x-, y-, and z-axes; an error value related to non-orthogonality of axes of the first gimbal 210; error values related to platform rotation about x-, y-, and z-axes; an error value related to non-orthogonality of axes of the second gimbal 224; error values related to the second directional payload's rotation about x-, and y-axes. The second directional payload's rotation about a z-axis may also be considered in some embodiments. As used herein, the term exemplary indicates an example and not necessarily an ideal.

The independently observable error variables may be estimated based on bore sight measurements related to the respective directional payload. For example, estimates of the independently observable error variable values for the second gimbal 224 and the first gimbal 210 may be determined based on bore sight measurements related to the second directional payload 234. The independently observable error variable values may be used to determine corrected gimbal angles to point the directional payloads 228, 234, 236 at specified targets.

During operation, the controller 204 receives sensory information and provides control information and direction, in order to control and adjust the directional payloads 228, 234, 236. In a particular embodiment, the beacon tracking module 252 receives sensory information detected from one or more of the directional payloads 228, 234, 236 and communicates the received sensory information to the controller 204 via the controller interface 240. The beacon tracking module 252 processes the received sensor data and based on the received sensor data, the beacon tracking module 252 can provide updated target location and the difference between the commanded pointing direction and the tracked pointing direction. Alternatively, the antenna mapping module 254, based on the knowledge of target location, can command an antenna scanning motion with which, together with receiving antenna on the ground, the true antenna boresight where the maximum antenna signal power occurs relative the commanded antenna boresight can be determined. In both cases, the boresight difference data is provided to the gimbal compensation logic 250 as calibration measurement data. The gimbal compensation logic 250 estimates values of the independently observable error variables to calibrate the system so that corrected gimbal angles can be determined for other pointing directions, other host vehicle orientations, other platform orientations, or any combination thereof, and the directional payloads 228, 234, 236 can be pointed in a desired direction, such as at the target 270. In a particular embodiment, the values of the independently observable error variables are determined based on an estimation algorithm that estimates the values based on bore sight measurements from antenna mapping, beacon tracking or another measurement related to the pointing direction of one of the directional payloads 228, 234, 236.

The host vehicle attitude module 256 receives and processes attitude information related to the host vehicle 202. The host vehicle attitude information can be provided to the gimbal compensation logic 250 to adjust the gimbal angles of one or more of the gimbals 210, 224, 226. For example, the host vehicle attitude information can be used to maintain the pointing direction of the first directional payload 228 by adjusting the gimbal angles of the first gimbal 210. Additionally, the host vehicle attitude information, information about adjustments made to the first gimbal angles, or both, may be provided to the gimbal compensation logic 250 to determine adjusted gimbal angles for the second gimbal 224, the third gimbal 226, or both to maintain a pointing direction of the respective directional payloads 234, 236 when the orientation of the platform 220 is changed.

The antenna mapping module 254 provides antenna scanning motion profiles and processes the corresponding received power profile at a target to produce boresight error data that may be used to calibrate the gimbals, and to direct and control an antenna, such as an antenna at one or more of the directional payloads 228, 234, or 236. In a particular embodiment, the antenna mapping module 254 includes logic or instructions to determine gimbal angle error values, either directly obtained or derived from bore sight pointing errors. For example, the antenna mapping module 254 may determine the strength of a signal transmitted to a target, such as the target 270. The antenna mapping module 254 may compare the determined signal strength to a maximum or peak signal strength that may be measured or predetermined.

The gimbal angle error values may be used by the gimbal compensation logic 250 to determine gimbal angle corrections, which may be used to adjust the pointing direction of an antenna. In a particular embodiment, the antenna mapping module 254 determines the gimbal angle values based on multiple positions of the gimbals. For example, the gimbal angle error values of the first gimbal 210 and the second gimbal 224 may be determined based on pointing the second directional payload 234 at two or more beacons at different locations, such that the gimbal angles of the first and second gimbals 210, 224 are different for pointing at each beacon. In another example, the gimbal angle error values of the first gimbal 210 and the second gimbal 224 are determined based on different orientations of the host vehicle 202 while pointing the second directional payload 234 at one or more beacons, such that the gimbal angles of the first and second gimbals 210, 224 are different for pointing at each host vehicle orientation to gain linearly independent measurement data.

In a particular embodiment, the gimbal compensation logic 250 determines one or more gimbal angle correction values based on the error values of the gimbals 210, 224, 226 and gimbal angles when the error measurements are taken. For example, the gimbal compensation logic 250 may determine gimbal angle correction values for the first gimbal 210 based on a bore sight measurement of the first directional payload 228. In another example, the gimbal compensation logic 250 determines gimbal angle correction values for the first gimbal 210, the second gimbal 224, or both, based on a bore sight measurement of the second directional payload 234. In yet another example, the gimbal compensation logic 250 determines gimbal angle correction values for the first gimbal 210, the third gimbal 226, or both, based on a bore sight measurement of the third directional payload 236. The gimbal angle error correction values may be used by the gimbal compensation logic 250 to adjust gimbal angles of the gimbals 210, 224, 226 to control pointing of the directional payloads 228, 234, 236.

In a particular embodiment, the gimbal angle compensation logic 250 is adapted to receive host vehicle attitude data from the host vehicle attitude module 256 to adjust the attitude of one or more of the directional payloads, such as the first directional payload 228, to maintain a first specified pointing direction and to adjust the attitude of another directional payload, such as the second directional payload 234, to maintain a second specified pointing direction. As shown, the gimbal compensation logic 250 may control one, two, or all of the directional payloads 228, 234, 236. The gimbal compensation logic 250 may also maintain a specified pointing direction for each of the directional payloads 228, 234, and 236 independently of the pointing direction of the other directional payloads and independently of the orientation of the host vehicle 202. Further, the gimbal compensation logic 250 can calibrate the gimbal system, including the first gimbal 210, the second gimbal 224, the third gimbal 226, or any combination thereof, based on beacon tracking measurements or bore sight measurements of one or more of the directional payloads 228, 234, 236. For example, the gimbal compensation logic 250 may determine gimbal angle correction values to adjust various gimbal angles of the gimbals 210, 224, 226 to compensate for pointing errors in the system.

Figure 3:
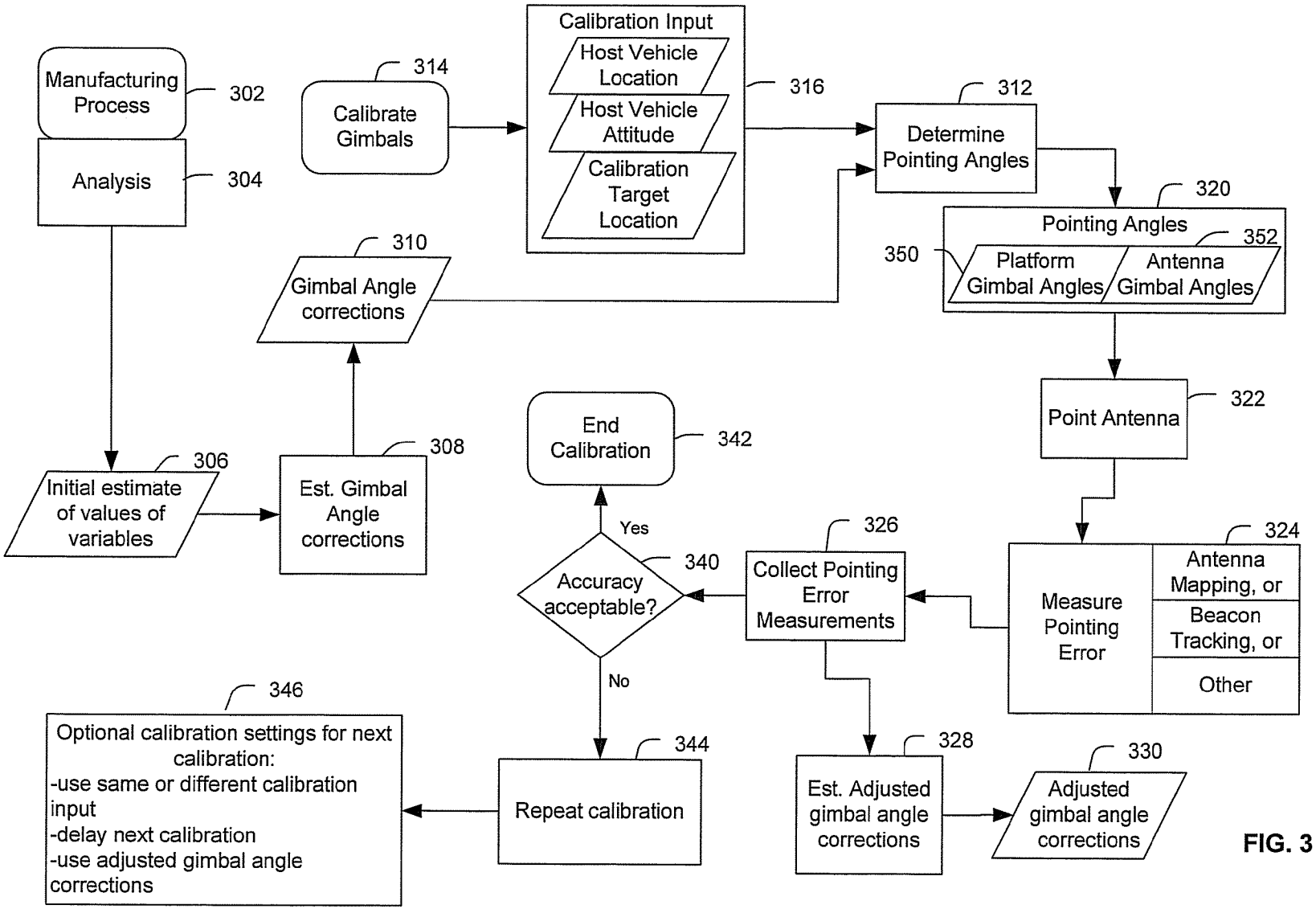
FIG. 3 is flow diagram of a particular embodiment of a method of performing gimbal calibration.

Referring to FIG. 3, a particular embodiment of a method of performing gimbal calibration is illustrated. The method relates to calibrating a gimbal system including at least two gimbals, where each gimbal has at least two axes. The method includes, at 304, performing an initial analysis of a gimbal system as part of a manufacturing process 302. Based on the manufacturing process 302 and the initial analysis 304, an initial estimate of values of gimbal variables 306 are determined. The initial estimate of values of gimbal variables 306 may include estimates of independently observable error values related to each gimbal of the gimbal system. Based on the initial estimate of the values of various variables 306, an estimate of gimbal angle corrections 310 is determined, at 308.

At 314, a calibration process begins. The calibration process 314 includes providing a calibration input 316. For example, the calibration input can include information to a specific pointing direction of a directional payload coupled to the gimbal system. To illustrate, the calibration input may include host vehicle location data, host vehicle attitude data, and data specifying a calibration target. The calibration input 316 and the gimbal angle corrections 310 may be used, at 312, to determine pointing angles 320 for each gimbal of the gimbal system. For example, the gimbal pointing angles 320 can include platform gimbal angles 350 and antenna gimbal angles 352.

At 322, the directional payload (e.g., an antenna, laser, or other directional device) is pointed by setting the gimbal angles of the gimbal system to the pointing angles 320. The method further includes, at 324, measuring a pointing error of the directional payload. For example, the pointing error can be measured by performing antenna mapping, beacon tracking or other pointing device detection and error correction calculations. The pointing error measurements are collected, at 326, and used, at 328, to generate an estimate of adjusted gimbal angle corrections 330. Additionally, the pointing error measurements are used to determine, at 340, whether the pointing accuracy is acceptable. If the pointing accuracy is acceptable, the calibration process ends, at 342. If the pointing accuracy is not acceptable, at 340, then the calibration process is repeated in an iterative fashion, at 344.

Additionally, the settings for subsequent calibrations may be adjusted, at 346. The calibration settings may use the same or a different calibration input. For example, the host vehicle location, the host vehicle attitude, or the calibration target location may be changed for subsequent calibrations. The calibration settings may also use adjusted gimbal angle corrections 330 rather than the estimated gimbal angle corrections 308 to determine the pointing angles 320, at 312. Additionally, other factors such as diurnal effects (e.g., effects of heating and cooling each day) may be accounted for by performing subsequent calibrations at various times during the day. Thus, the next calibrations may be delayed until a time when the diurnal effects can be accounted for. For example, the pointing error measurements 324 may be determined at a plurality of different times during the calibration phase. In a particular illustrative embodiment, the time period between determining two or more pointing error measurements is selected to reduce influences of cyclic errors on gimbal angle corrections and adjustments. In another particular illustrative embodiment, for each pointing error measurement, multiple consecutive data points can be taken to reduce the influence of measurement noise.

Figure 4:
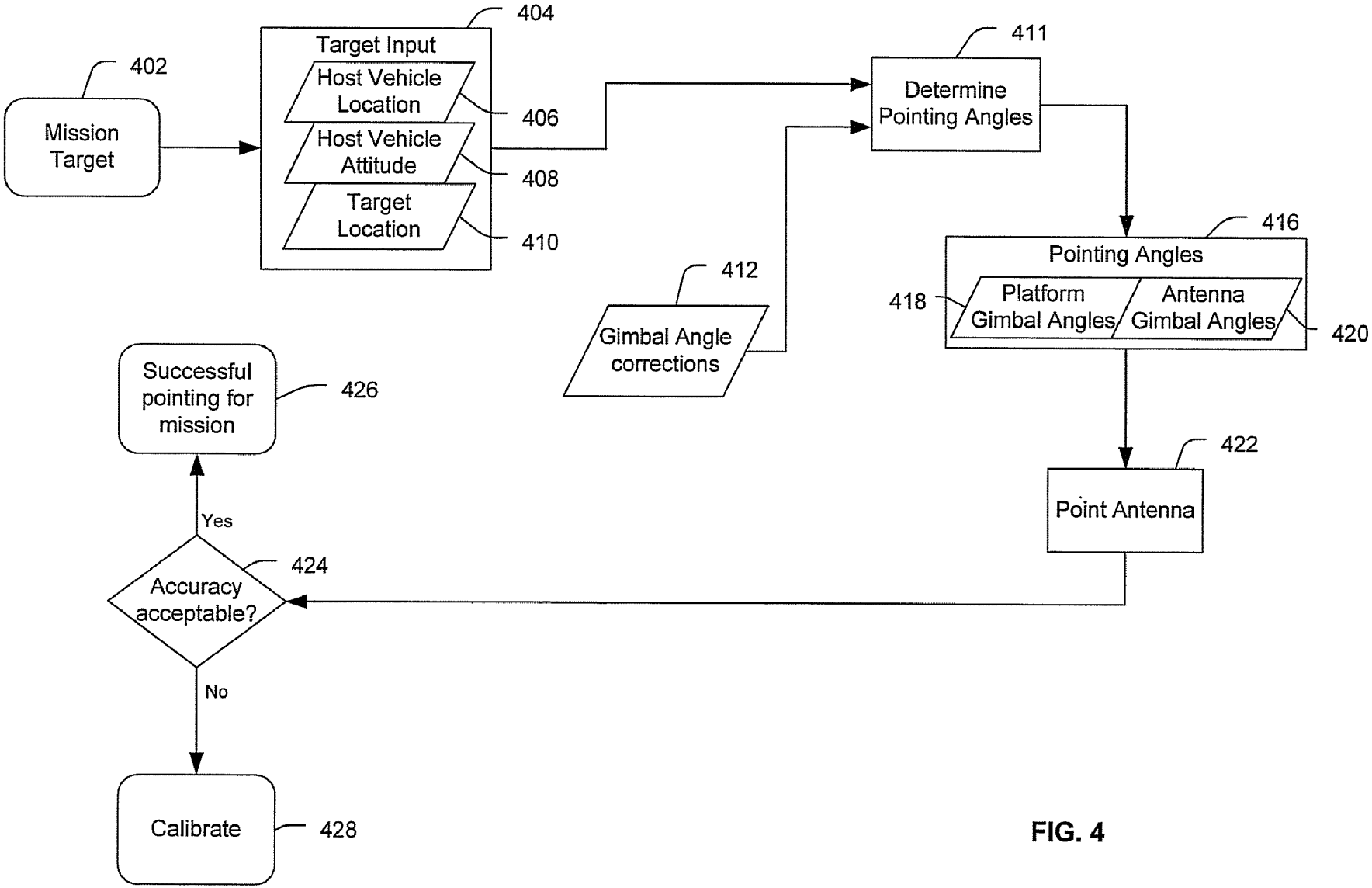
FIG. 4 is flow diagram of a particular embodiment of a method of using gimbal angle corrections to point a directional payload.

Referring to FIG. 4, a particular embodiment of a method of using gimbal angles corrections to point a directional payload is illustrated. The method includes identifying a mission target 402 and providing a target input 404 specifying the mission target 402. The target input 404 may include host vehicle location data 406, host vehicle attitude data 408, target location data 410, other data to specify the mission target 402, or any combination thereof. The target input 404 and gimbal angle corrections 412 are used, at 411, to determine pointing angles 416. The pointing angles 416 may include pointing angles related to more than one gimbal of a gimbal system. In a particular illustrative embodiment, the gimbal system includes at least two gimbals, a platform gimbal and an antenna gimbal. Additionally, each gimbal includes at least two axes, an azimuth axis and a elevation axis. Thus, the pointing angles 416 may include platform gimbal angles 418 specifying an azimuth angle and an elevation angle, and antenna gimbal angles 420 specifying an azimuth angle and an elevation angle.

In a particular embodiment, the gimbal angle corrections 412 are determined by an iterative calibration process, such as the calibration method illustrated in FIG. 3. For example, the gimbal angle corrections 412 can be based on a set of independently observable error values that are estimated based on measurements of pointing error related to the directional payload.

The method also includes pointing the antenna or other directional payload using the pointing angles, at 422. For example, the platform gimbal angles 418 can be used to adjust the orientation of a platform gimbal and the antenna gimbal angles can be used to adjust the orientation of an antenna gimbal.

After the pointing direction of the antenna or other pointing device has been set based on pointing angles 416, the method determines the accuracy of the pointing. For example, an error in the pointing direction may be determined based on bore sight measurements. If the accuracy is acceptable, at 424, then successful pointing for the mission has been accomplished and the method ends, at 426. If the accuracy is not acceptable, at 424, then the method proceeds to perform a calibration of the gimbal system, at 428. A particular illustrative method of performing gimbal calibration is shown with respect to FIG. 3.

Figure 5:
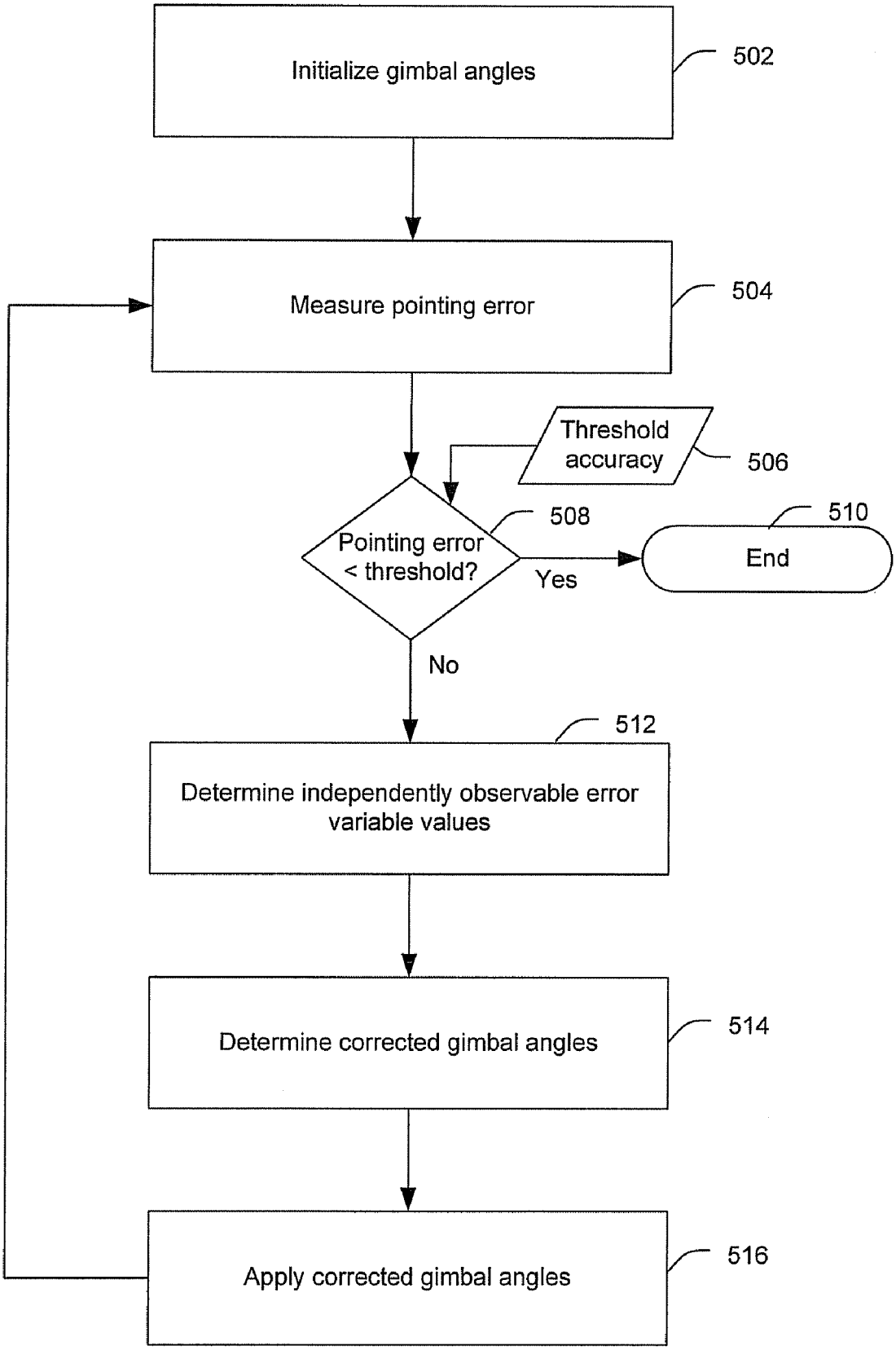
FIG. 5 is a flow diagram of a particular embodiment of a method of determining corrected gimbal angles.

Referring to FIG. 5, a method of determining corrected gimbal angles is shown. The method includes initializing a set of gimbal angles, at 502. The gimbal angles may be initialized based on estimates of gimbal angle error and the relative position and attitude of a target and a system associated with a pointing device (such as a host vehicle and a gimbal system that includes at least two, two-axis gimbals). The method also includes, at 504, measuring a pointing error of the pointing device, such as an antenna, a laser, an optical device, or another pointing device. At 508, the measured pointing error is compared to a threshold 506. If the pointing error is less than the threshold 506, then the method is completed at 510.

If the measured pointing error is not less than the threshold 506, then the method proceeds to 512 where a set of independently observable error variable values are determined. The independently observable error variable values may be determined based on measurements of the pointing error. For example, the pointing error measurement may include a bore sight measurement to determine an actual pointing direction of the pointing device. The actual pointing direction and the expected pointing direction based on the gimbal angles may be used to estimate error values related to independently observable error variables. For example, where the system associated with the pointing device includes a host vehicle, a first gimbal coupled to the host vehicle and supporting a platform, and a second gimbal coupled to the platform supporting the pointing device, the independently observable error variables may include rotation of the host vehicle about an x-, y- or z-axis; non-orthogonality of the first gimbal; rotation of the platform about an x-, y-, or z-axis; non-orthogonality of the second gimbal; rotation of the pointing device about an x-, y-, or z-axis; or any combination thereof.

The method further includes, at 514, determining corrected gimbal angles. The corrected gimbal angles may be determined based on the independently observable error variable values. For example, the corrected gimbal angles may be gimbal angles that minimize or reduce pointing error based on the independently observable error variable values. The method also includes, at 516, applying the corrected gimbal angles to point the pointing device. The method may repeat iteratively, by returning to 504 to again measure the pointing error, until the pointing error is less than the threshold accuracy 506.

Figure 6:
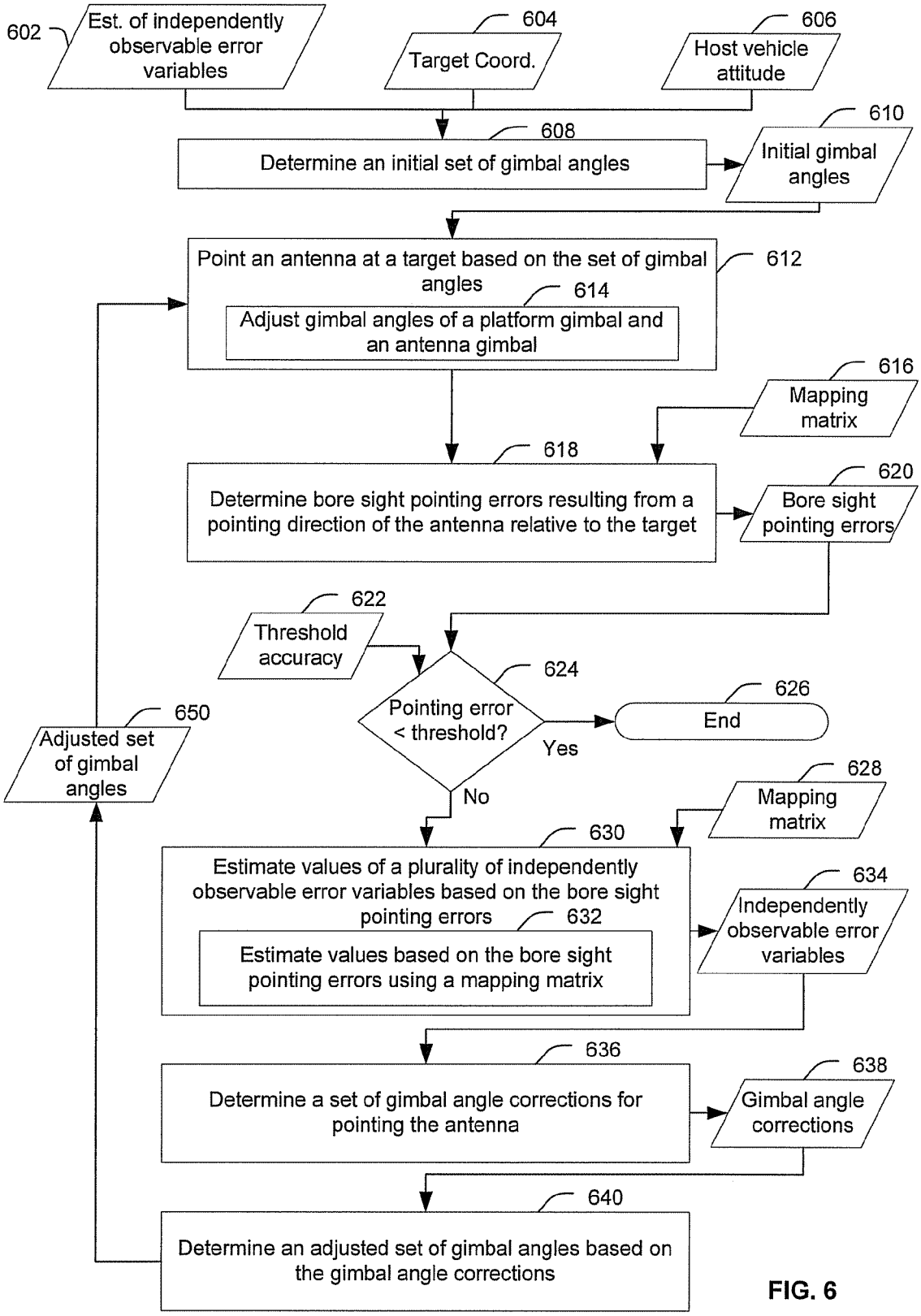
FIG. 6 is a flow diagram of a particular embodiment of a method of adjusting gimbal angles.

Referring to FIG. 6, a method of adjusting gimbal angles is shown. In a particular embodiment, the method is used with respect to a gimbal system that includes at least two, two-axis gimbals moveably coupling a pointing device (e.g., an antenna, a laser, or an optical device) to a host vehicle (e.g., a satellite, aircraft, or ship), such as the systems illustrated in FIGS. 1 and 2. The method includes, at 608, determining an initial set of gimbal angles 610 based on an estimate of independently observable error variable values 602, target coordinates 604 for a pointing device, and host vehicle attitude data 606. The independently observable error values may be estimated based on analysis of the gimbal system after manufacturing, based on previous measurements related to the error values, or any combination thereof. The initial set of gimbal angles 610 can be determined by calculating an azimuth and an elevation angle for each gimbal based on the target coordinates 604 and the host vehicle attitude data 606 and accounting for the estimates of the independently observable error variables 602. In an illustrative embodiment, the independently observable error variable values 602 include error values related to rotation of host vehicle about an x-, y- or z-axis; an error value related to non-orthogonality of the first gimbal; error values related to rotation of the platform about an x-, y-, or z-axis; an error value related to non-orthogonality of the second gimbal; error values related to rotation of the pointing device about an x-, y-, or z-axis; or any combination thereof.

The method also includes, at 612, pointing the pointing device, which may be an antenna, at a target based on a set of gimbal angles. During a first pass through the method, the set of gimbal angles may be the initial set of gimbal angles 610. In a particular embodiment, pointing the pointing device at the target includes, at 614, adjusting the gimbal angles of a platform gimbal and of an antenna gimbal.

The method may also include, at 618, determining bore sight pointing errors 620 resulting from a pointing direction of the antenna relative to the target. The bore sight pointing errors may be detected by performing an adjustment of the pointing device with respect to a bore sight maximum signal sensing measurement and by determining differences in direction between the bore sight maximum point and the prior target point to determine the bore sight pointing errors 620. The bore sight pointing measurement may be observed and used to identify gimbal angles needing adjustment. In a particular embodiment, a mapping matrix 616 is used in connection with performing the bore sight measurement to provide mapped pointing errors with respect to each of the gimbal angles.

At 624, the bore sight pointing error data 620 is compared to a pointing error threshold 622. If the pointing error 620 is less than the threshold 622, then the method terminates at 626. If the pointing error 620 is not less than the threshold 622, then the method continues to 630. At 630, the method estimates a plurality of independently observable error values 634 based on the bore sight pointing errors 620. In a particular embodiment, values of the independently observable error variables may be estimated, at 632, based on the bore sight pointing errors using a mapping matrix 628.

The method may also include, at 636, determining a set of gimbal angle corrections 638 based on the independently observable error variable values 634. The gimbal angle corrections 638 may be used, at 640, to determine an adjusted set of gimbal angles 650 for pointing the antenna to compensate for the measured bore sight pointing errors. The adjusted set of gimbal angles 650 may be used to adjust the pointing of the antenna to point at the target (or at a new target) based on the adjusted set of gimbal angles 650. The method may iterate until the observed bore sight pointing errors 620 are less than the threshold 622. After the threshold accuracy 622 is achieved, new gimbal angle corrections 638 may be calculated based on the estimated independently observable error variable values 634 to point the pointing device based on other target coordinates or other host vehicle attitude data 606.

Figure 7:
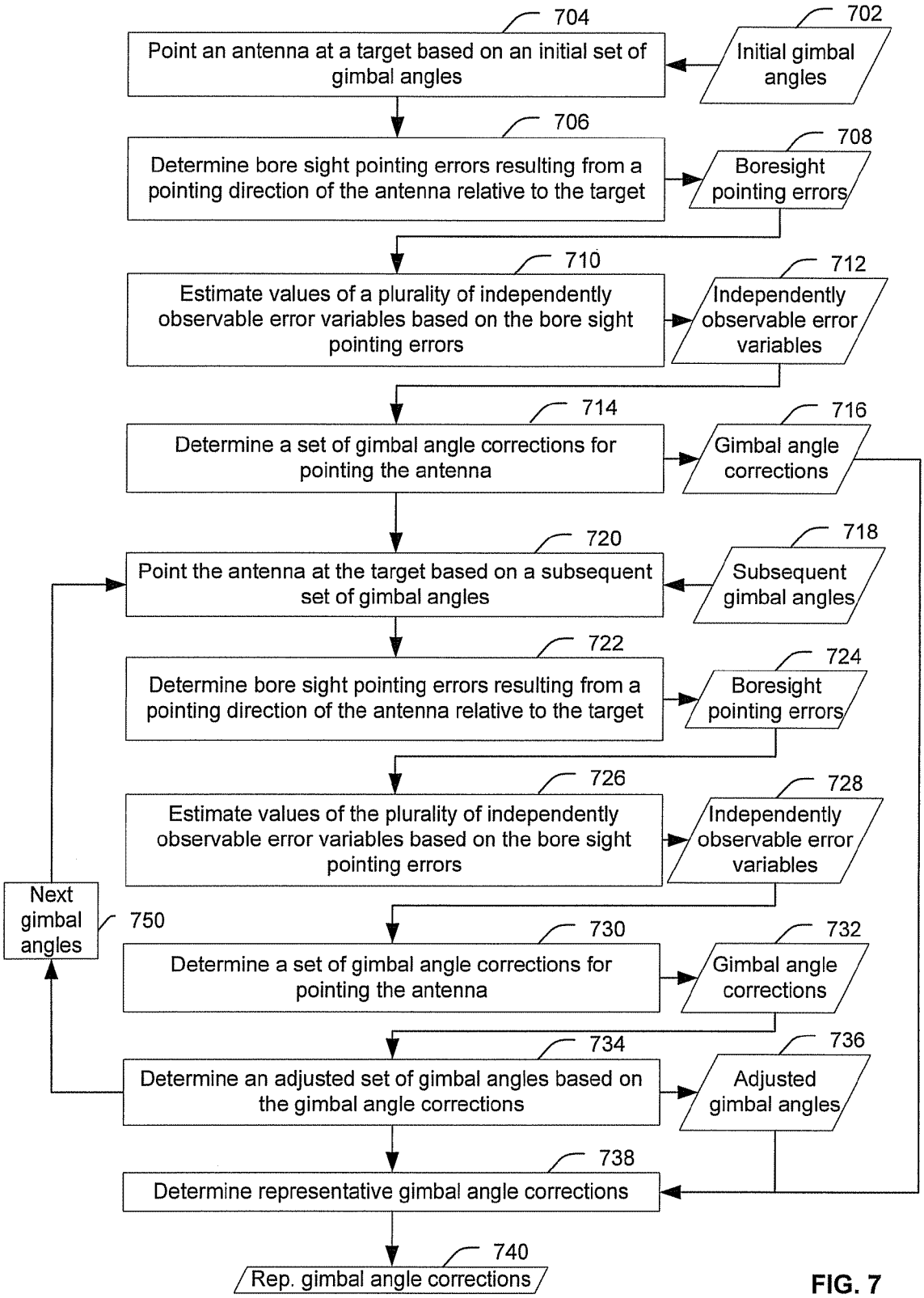
FIG. 7 is a flow diagram of a second particular embodiment of a method of adjusting gimbal angles.

Referring to FIG. 7 a method of adjusting gimbal angles is shown. In a particular embodiment, the method may be used with respect to a gimbal system including two or more gimbals, each having two or more axes, such as the gimbal systems illustrated in FIGS. 1 and 2. The method of FIG. 7 illustrates calibrating the gimbal system based on multiple attitudes of a host vehicle coupled to the gimbal system. To maintain a pointing direction using the gimbal system as the host vehicle attitude changes, gimbal angles of the gimbal system are adjusted to maintain the pointing direction.

The method includes, at 704, pointing an antenna at a target based on the initial set of gimbal angles 702. For example, the initial set of gimbal angles 702 may specify an azimuth angle and an elevation angle for each of the two or more gimbals of the gimbal system. The method further includes, at 706, determining bore sight pointing errors 708 resulting from a pointing direction of the antenna relative to the target. The method also includes, at 710, estimating values of a plurality of independently observable error variables based on the bore sight pointing errors 708 to produce the independently observable error variable values 712. In a particular illustrative embodiment, the independently observable error variables include variables related to error that can be observed based on bore sight measurements with respect to the antenna (or other pointing device). For example, where the gimbal system includes a host vehicle interface, a platform gimbal coupled to the host vehicle interface and supporting a platform, and an antenna gimbal coupled to the platform supporting the antenna, the independently observable error variables may include rotation of the host vehicle about an x-, y- or z-axis; non-orthogonality of the first gimbal; rotation of the platform about an x-, y-, or z-axis; non-orthogonality of the second gimbal; rotation of the pointing device about an x-, y-, or z-axis; or any combination thereof.

The method also includes, at 714, determining a set of gimbal angle corrections 716 for pointing the antenna. The gimbal angle corrections 716 adjust the initial gimbal angles 702 to account for the independently observable error variable values 712.

The method also includes, at 720, pointing the antenna at the target based on a subsequent set of gimbal angles 718. The subsequent set of gimbal angles 718 may include gimbal angles to point at the target from a different location or based on a different host vehicle attitude than the initial set of gimbal angles 702.

In a particular embodiment, the method further includes, at 722, determining bore sight pointing errors 724 resulting from a pointing direction of the antenna relative to the target using the subsequent set of gimbal angles 718. The method may also include, at 726, estimating the values of the plurality of independently observable error variables based on the bore sight pointing errors 724 to produce a second set of independently observable error variable values 728.

The second set of independently observable error variable values 728 may be used, at 730, to determine a second set of gimbal angle corrections 732 for pointing the antenna. The method may also include, at 734, determining an adjusted set of gimbal angles 736 based on the second set of gimbal angle corrections 732.

In a particular embodiment, a next set of gimbal angles is provided to point the antenna, at 750. The next set of gimbal angles may point at the same target from a different location of the antenna (or host vehicle) or from a different orientation of the host vehicle. Alternately, the next set of gimbal angles may point to a different target.

In a particular embodiment, the adjusted set of gimbal angles 736, the first set of gimbal angle corrections 716, the second set of gimbal angle corrections, other gimbal angle corrections or adjusted gimbal angles, or any combination thereof, may be used, at 738, to determine representative gimbal angle corrections 740. The representative gimbal angle corrections 740 are used to control the gimbal system with respect to pointing of an antenna or other pointing device.

Figure 8:
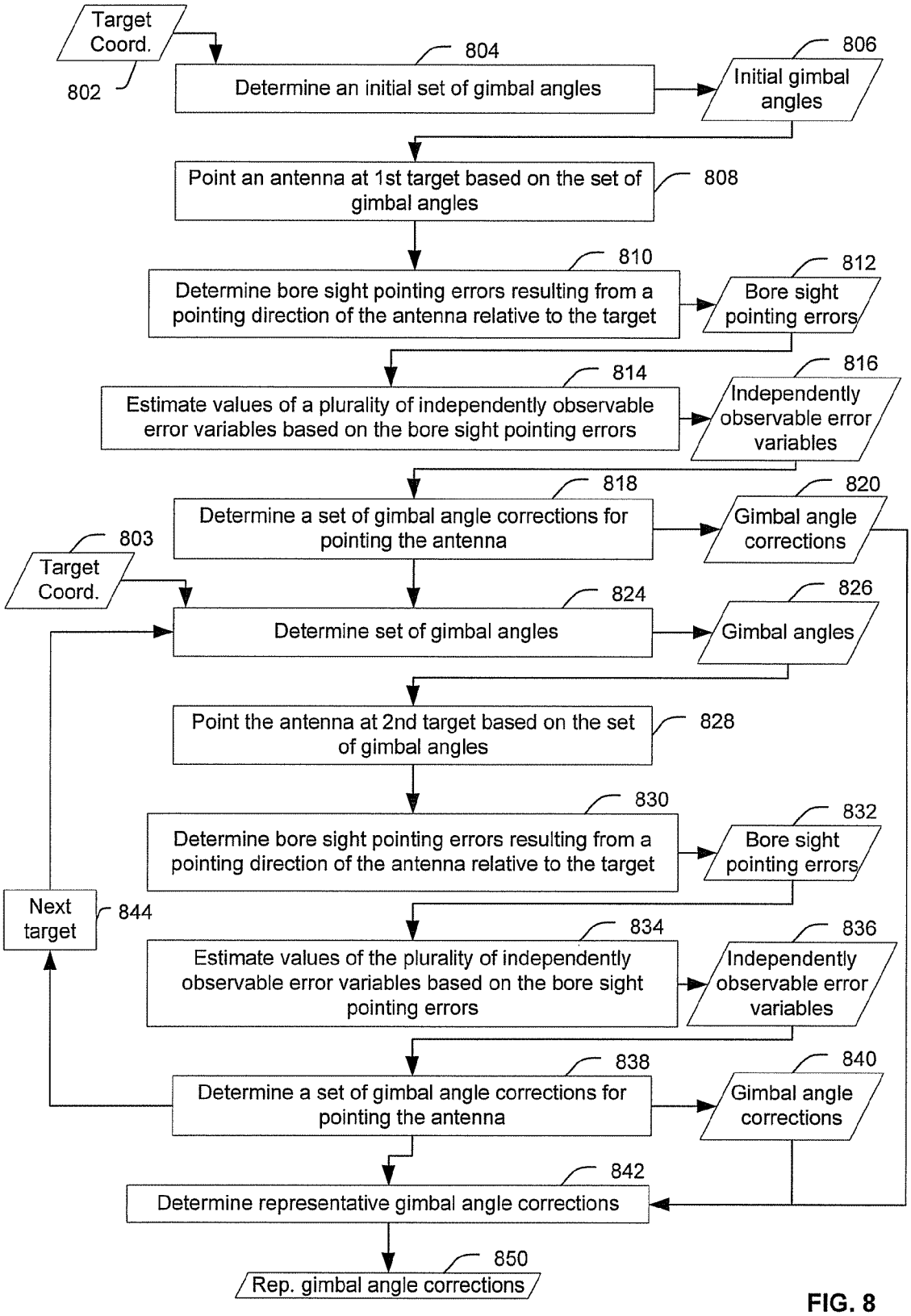
FIG. 8 is a flow diagram of a third particular embodiment of a method of adjusting gimbal angles.

Referring to FIG. 8, another illustrative embodiment of a method of adjusting gimbal angles is shown. In a particular embodiment, the method may be used with respect to a gimbal system that includes at least two, two-axis gimbals moveably coupling a pointing device (e.g., an antenna, a laser, or an optical device) to a host vehicle (e.g., a satellite, aircraft, or ship), such as the systems illustrated in FIGS. 1 and 2. The method illustrated in FIG. 8 relates to calibrating the gimbal system using two or more sets of target coordinates.

The method includes, at 804, determining an initial set of gimbal angles 806 based on target coordinates 802 of a first target. The method also includes, at 808, pointing an antenna at the first target based on the initial set of gimbal angles 806. The method further includes, at 810, determining bore sight pointing errors 812 resulting from a pointing direction of the antenna relative to the target. For example, the bore sight pointing errors 812 may indicate that a peak signal strength of the antenna is not aligned with the first target.

Based on the bore sight pointing errors 812, values of independently observable error variables 816 may be estimated, at 814. In an illustrative embodiment, the independently observable error variable values 816 include error values related to rotation of the host vehicle about an x-, y- or z-axis; an error value related to non-orthogonality of the first gimbal; error values related to rotation of the platform about an x-, y-, or z-axis; an error value related to non-orthogonality of the second gimbal; error values related to rotation of the pointing device about an x-, y-, or z-axis; or any combination thereof. The values of the independently observable variables 816 may be estimated based on a set of boresight pointing errors 812 obtained from measuring the location of the peak signal strength of the antenna relative to the target direction as determined by the current values of the independently observable variables 816 and other associated knowledge. The method also includes, at 818, determining a set of gimbal angle corrections 820 for pointing the antenna based on the independently observable error variables 816.

The method may also include, at 824, determining a second set of gimbal angles 826 to point at a second or subsequent target 803. The second set of gimbal angles 826 may be determined taking into consideration the previously determined gimbal angle corrections 820, or without considering the previously determined gimbal angle corrections 820.

The method also includes, at 828, pointing an antenna at the second target based on the second set of gimbal angles 826, and, at 830, determining bore sight pointing errors 832 resulting from a pointing direction of the antenna relative to the second target. Based on the bore sight pointing errors 832, values of the independently observable error variables 836 may be estimated, at 834. The independently observable error variables 836 may be the same as the previous independently observable variables 816, or may include different variables. For example, the first bore sight pointing errors 812 may be used to determine values of a first subset for the independently observable variables, and the second bore sight pointing errors 832 may be used to determine values of a second subset of the independently observable variables.

The method also includes, at 838, determining a second set of gimbal angle corrections 840 for pointing the antenna based on the independently observable error variables 836. The method may iteratively determine additional gimbal angle corrections based on different target coordinates by providing coordinates of a next target 844. Additionally, a representative set of gimbal angle corrections 850 may be determined, at 842, based on the first gimbal angle corrections 820, the second gimbal angle corrections 840, subsequent gimbal angle corrections based on iterations of the method, or any combination thereof. The representative gimbal angle corrections 850 may be used to point the antenna during operation.

Figure 9:
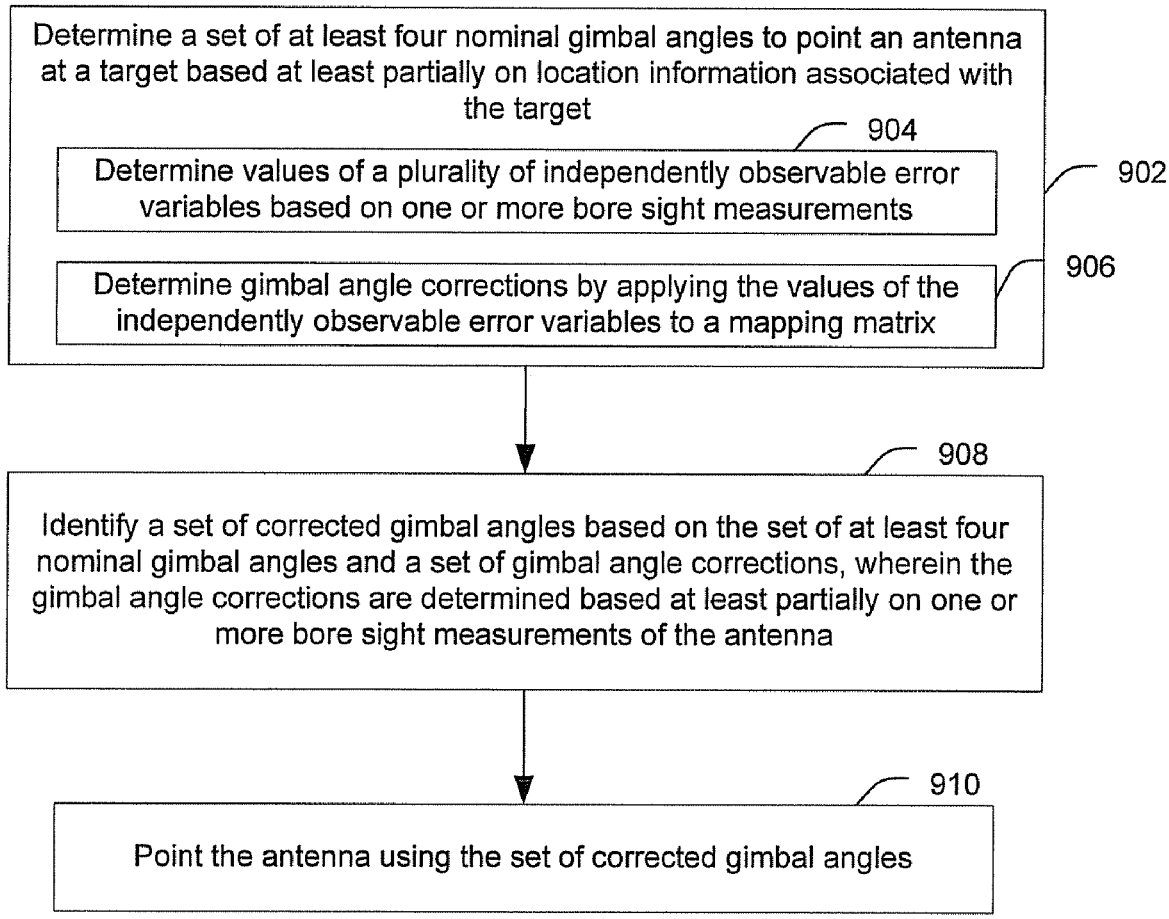
FIG. 9 is a flow diagram of a particular embodiment of method of pointing an antenna.

Referring to FIG. 9, a method of pointing an antenna is shown. The method includes, at 902, determining a set of at least four nominal gimbal angles to point an antenna at a target based at least partially on location information associated with the target. In a particular embodiment, the set of at least four nominal gimbal angles is used to position a first gimbal coupled to a host vehicle and a second gimbal coupled to the first gimbal. In addition, the set of at least four nominal gimbal angles may be determined based at least partially on attitude information related to the host vehicle and the coordinates of a first target. The set of at least four nominal gimbal angles may include an azimuth and an elevation angle for a first gimbal, and an azimuth and an elevation angle for a second gimbal. In an illustrative embodiment, the set of at least four nominal gimbal angles is determined by, at 904, determining values of a plurality of independently observable error variables based on one or more bore sight measurements, and, at 906, determining gimbal angle corrections by applying the values of the independently observable error variables to a mapping matrix.

The method also includes, at 908, identifying a set of adjusted or corrected gimbal angles based on the set of at least four nominal gimbal angles and based on a set of gimbal angle corrections. The gimbal angle corrections may be determined based at least partially on one or more bore sight measurements of the antenna.

In a particular embodiment, the method further includes, at 910, pointing the antenna using a gimbal system that receives the set of corrected gimbal angles. Thus, the method conveniently uses readily available bore sight measurements of a pointing device, such as an antenna, to determine independently observable error variable values to adjust the gimbal angles to compensate for errors in pointing of the pointing device.

Figure 10:
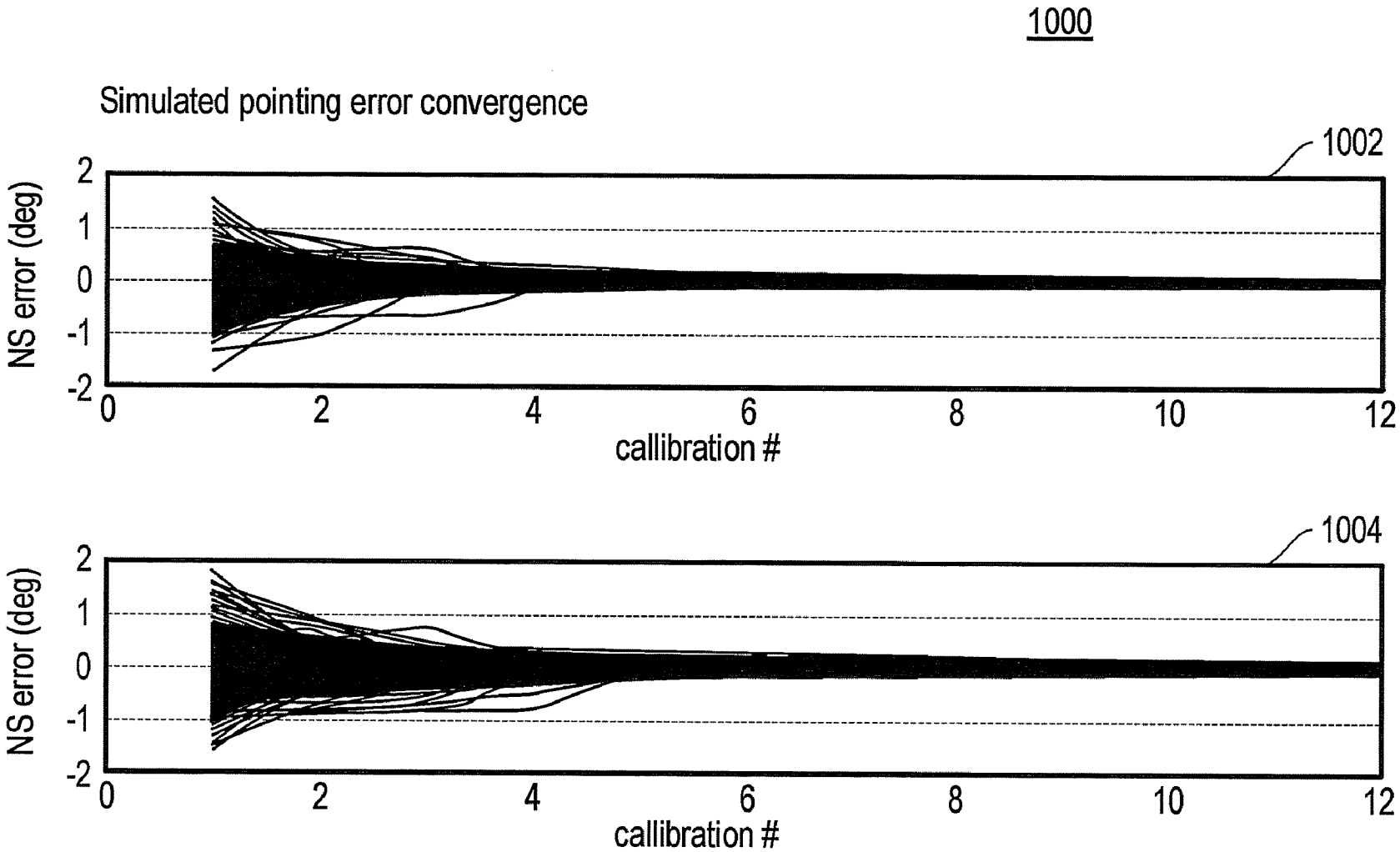
FIG. 10 is a general diagram that illustrates pointing error convergence associated with a method of applying adjusted gimbal angles based on estimated values of a plurality of independently observable error variables.

FIG. 10 depicts a graph that illustrates representative pointing error data expected based on simulation of the calibration methods and systems previously discussed. The graph shows convergence of calibration data related to calibrating pointing of an antenna mounted on two gimbals with each of them having two axes. Simulated pointing error convergence data 1002 illustrates that North-South error decreases as the number of calibrations increases. Similarly, the simulated error convergence data 1104 illustrates that East-West error decreases as the number of calibrations increases. The calibration simulation is based on using bore sight observations to determine values of a set of independently observable error variables. Specifically, the independently observable error variables simulated include: rotation of a host vehicle about an x-, y- or z-axis; non-orthogonality of a first gimbal mounted to the host vehicle; rotation of a platform mounted to the first gimbal about an x-, y-, or z-axis; non-orthogonality of a second gimbal mounted to the platform; and rotation of the antenna mounted to the second gimbal about an x- or y-axis.

The disclosed double gimbal system calibration approach is useful for applications with moving host vehicles, such as satellite applications where multiple mission functionality is desired. For example, a first 2-axis platform gimbal can compensate for motion of the satellite based on real-time commands while a secondary 2-axis antenna gimbal can be used for target tracking based on the relatively stable platform afforded by the platform gimbal system. The teachings of this disclosure can be expanded for use with more than two 2-axis gimbal components, such as for a gimbal system including three or more gimbals. The calibration approach disclosed beneficially provides operational flexibility to support a robust calibration technique without requiring a user to provide multiple geometrically diverse calibration targets. Thus, calibration target selection is simplified.

What is claimed is:

1. A method, comprising:

determining a set of at least four nominal gimbal angles to point an antenna at a target based at least partially on location information associated with the target;

identifying a set of corrected gimbal angles based on the set of at least four nominal gimbal angles and based on a set of gimbal angle corrections, wherein the set of gimbal angle corrections are determined based at least partially on one or more bore sight measurements of the antenna; and pointing the antenna using the set of corrected gimbal angles.

2. The method of claim 1, wherein determining the set of gimbal angle corrections based at least partially on one or more bore sight measurements of the antenna comprises:

determining values of a plurality of independently observable error variables based on the one or more bore sight measurements, and determining the set of gimbal angle corrections by applying the values of the independently observable error variables to a mapping matrix.

3. A system comprising:

a host vehicle interface adapted to be coupled to a host vehicle; and a gimbal system, comprising:

a first gimbal coupled to the host vehicle interface;

a platform coupled to the first gimbal;

a second gimbal coupled to the platform; and a first directional payload interface coupled to the second gimbal;

wherein an attitude of a first directional payload coupled to the first directional payload interface is adjustable using the gimbal system based on gimbal angle compensation logic.

4. The system of claim 3, further comprising a controller including the gimbal angle compensation logic, wherein the controller determines gimbal angle error values based on a calibration of the gimbal system to a bore sight of the first directional payload.

5. The system of claim 3, further comprising a beacon tracking module to determine gimbal angle error values, either directly obtained or derived from bore sight pointing errors, used by the gimbal angle compensation logic by changing gimbal angles of the gimbal system to detect a maximum ground beacon signal attained.

6. The system of claim 3, further comprising an antenna mapping module to determine gimbal angle error values, either directly obtained or derived from bore sight pointing errors.

7. The system of claim 3, wherein the gimbal angle compensation logic is adapted to receive host vehicle attitude data and to adjust the attitude of the first directional payload to maintain a specified pointing direction.

8. The system of claim 3, wherein the platform comprises a platform interface and a second directional payload coupled to the platform interface, and wherein an attitude of the second directional payload is adjustable by the gimbal angle compensation logic using the first gimbal.

9. The system of claim 8, wherein the gimbal angle compensation logic is adapted to receive host vehicle attitude data, to adjust the attitude of the first directional payload to maintain a first specified pointing direction, and to adjust the attitude of the second directional payload to maintain a second specified pointing direction.

10. A method, comprising:

pointing an antenna at a first target using an initial set of at least four gimbal angles, wherein coordinates of the first target are known;

determining first bore sight pointing errors resulting from a pointing direction of the antenna relative to the first target;

estimating values of a plurality of independently observable error variables based on the first bore sight pointing errors; and determining, based on the values of the plurality of independently observable error variables, a set of gimbal angle corrections.

11. The method of claim 10, wherein the values of the plurality of independently observable error variables are estimated based on the bore sight pointing errors using an estimation algorithm.

12. The method of claim 10, further comprising:

determining an adjusted set of at least four gimbal angles or a subset of the gimbal angles based on the set of gimbal angle corrections;

pointing the antenna at the first target using the adjusted set of at least four gimbal angles or the subset of the gimbal angles;

determining subsequent bore sight pointing errors resulting from the pointing direction of the antenna using the adjusted set of at least four gimbal angles or the subset of the gimbal angles relative to the first target;

estimating the values of the plurality of independently observable error variables based at least partially on the subsequent bore sight pointing errors; and determining, based on the values of the plurality of independently observable error variables, a subsequent set of gimbal angle corrections.

13. The method of claim 12, wherein a time period between determining the set of gimbal angle corrections and determining the subsequent set of gimbal angle corrections is selected to reduce influences of cyclic errors.

14. The method of claim 10, further comprising:

pointing the antenna at the first target using a second set of at least four gimbal angles, wherein the second set of at least four gimbal angles are different than the initial set of at least four gimbal angles;

determining second bore sight pointing errors resulting from the pointing direction of the antenna using the second set of at least four gimbal angles relative to the first target;

estimating the values of the plurality of independently observable error variables based on the first bore sight pointing errors and the second bore sight pointing errors; and determining, based on the values of the plurality of independently observable error variables, a subsequent set of gimbal angle corrections for pointing the antenna.

15. The method of claim 10, further comprising:

pointing the antenna at a second target using a second set of at least four gimbal angles, wherein coordinates of the second target are known and are different than the coordinates of the first target;

determining second bore sight pointing errors resulting from the pointing direction of the antenna using the second set of at least four gimbal angles relative to the second target;

estimating the values of the plurality of independently observable error variables based on the first bore sight pointing errors and the second bore sight pointing errors; and determining, based on the values of the plurality of independently observable error variables, a second set of gimbal angle corrections for pointing the antenna.

16. The method of claim 10, wherein the initial set of at least four gimbal angles are used to position a first gimbal coupled to a host vehicle and a second gimbal coupled to the first gimbal and coupled to the antenna.

17. The method of claim 10, further comprising:

determining the initial set of four gimbal angles based on initial estimates of the values of the plurality of independently observable error variables and information about the coordinates of the first target.

18. The method of claim 10, wherein:

the antenna is coupled to an antenna gimbal;

the antenna gimbal is coupled to a platform;

the platform is coupled to a platform gimbal;

the platform gimbal is coupled to a host vehicle; and the initial set of at least four gimbal angles are used to adjust gimbal angles of the platform gimbal and gimbal angles of the antenna gimbal.

19. The method of claim 18, further comprising determining the initial set of at least four gimbal angles based at least partially on attitude information related to the host vehicle and the coordinates of the first target.

20. The method of claim 19, wherein the independently observable error variables include at least one error variable related to one or more of an attitude of the host vehicle, an attitude of the platform, an attitude of the antenna, orthogonality of axes of the antenna gimbal, and orthogonality of axes of the platform gimbal.

* * * * *